United States Patent [19]

Ikeda et al.

[11] 4,126,389

[45] Nov. 21, 1978

[54] SCANNING TYPE VARIABLE MAGNIFICATION ELECTROPHOTOGRAPHIC COPYING MACHINE EMPLOYING COPY PAPER STORAGE ROLL

[75] Inventors: Hiroshi Ikeda, Aichi; Kenichi Arai, Toyokawa, both of Japan

[73] Assignee: Minolta Camera Kabushiki Kaisha, Azughi, Japan

[21] Appl. No.: 751,412

[22] Filed: Dec. 16, 1976

[30] Foreign Application Priority Data

Dec. 26, 1975 [JP] Japan ..... 50/156419

[51] Int. Cl.[2] ..... G03G 15/00

[52] U.S. Cl. ..... 355/13; 355/8; 355/55; 355/60

[58] Field of Search ..... 355/13, 8, 11, 29, 55-57, 355/59, 60

[56] References Cited

U.S. PATENT DOCUMENTS

| | | | |
|---|---|---|---|
| 3,751,158 | 8/1973 | Komori | 355/8 |
| 3,792,926 | 2/1974 | Knechtel et al. | 355/60 X |
| 3,884,574 | 5/1975 | Doi et al. | 355/8 X |
| 4,007,986 | 2/1977 | Komori et al. | 355/8 X |

*Primary Examiner*—Richard L. Moses

*Attorney, Agent, or Firm*—Wolder, Gross & Yavner

[57] ABSTRACT

A variable magnification electrophotographic copying apparatus includes an original holder and an original scanning mechanism of the original holder advancing type or of the scanning mirror advancing type. The focus of the image projector lens is adjusted concurrently with the speed of the scanning mirror or original carrier relative to the photosensitive drum speed to adjust the image magnification ratio. Copy paper is withdrawn from a roll thereof and advanced past a cutter through an image transfer station adjacent to the photosensitive drum. The cutter is actuated in response to the position of an indexing member movable along the length of the original and the relative speed of movement of the original or scanning mirror to actuate the cutter so as to cut the copy paper to a length corresponding to the length of the image of the original on the copy paper. The copy paper feed is synchronized with the image scanning so that the leading edge of the image coincides with the leading edge of the copy paper. Switches are actuated by the indexing member carried by the moving original holder or the indexing member of a stationary original holder carries the switches actuated by the scanning mirror carriage and controls the actuation of the cutter.

19 Claims, 9 Drawing Figures

SCANNING TYPE VARIABLE MAGNIFICATION ELECTROPHOTOGRAPHIC COPYING MACHINE EMPLOYING COPY PAPER STORAGE ROLL

BACKGROUND OF THE INVENTION

The present invention relates generally to an improved electrophotographic copying apparatus which utilizes a roll packaged type of copying paper and which has an adjustable magnification for reproducing copies of different magnification ratios, and more particularly it relates to an improved electrophotographic copying apparatus which permits the cutting of the copying paper into the length of the reproduced image regardless of the copying magnification ratio at which the image is formed.

A conventional type of electrophotographic copying apparatus employs what is known as a random cutting mechanism for cutting the copying paper withdrawn from a roll thereof to the length of an original to be copied. Such apparatuses are described in U.S. Pat. No. 3,651,727 and No. 3,614,220 in which the copying apparatuses shown in both of these patents are of the slit exposure type with the apparatus of the former patent performing the scanning of the original by the movement of optical means and the apparatus of the latter patent by the movement of the original holder. In both apparatuses, the original to be copied is placed on an original holder with an end aligned with a reference edge and then a slidable indicator member is moved along the original to align it with the other end of the original. By this alignment, means associated with the indicator member is adjusted to cut the copying paper into the length of the original so that upon operation of the copying apparatus, said means actuates a switch means to energize a cutter to cut the copy paper. Normally, such means is provided on the original holder or optical element for utilizing the scanning movements of either to actuate the cutter.

Furthermore, there has been proposed in recent years a copying apparatus with a magnification adjustment means which permits the reproductions of images at different copying or magnification ratios such as at normal 1:1 and at reduced 1:0.708 copying ratios.

In this type of electrophotographic copying apparatus such as that described in U.S. Pat. No. 3,614,222, the scanning speed for the original to be copied is retained at the same speed as the rotating speed of the photosensitive member onto which the image of the original is projected when obtaining a copy at a 1:1 copying ratio. On the other hand, if the $n$ th power magnification of the reproduction image is desired, the scanning speed of the original must be changed to $1/n$ th if the rotating speed of the photosensitive member is maintained constant.

In addition to the above change which requires the change in scanning speed, the optical length between the original and the photosensitive must be corrected. This is accomplished as described in U.S. Pat. No. 3,614,222 by shifting part of the optical system which includes first and second optical carriages movable at a speed ratio of 1:0.5 parallel to the original and a projection lens. Specifically, the second carriage and the lens are shifted to compensate the optical length when obtaining a copy at a different copying or magnification ratio.

In the above type of copier, the image of the original is scanned by the first carriage and then reflected to the second carriage moving at half the speed of the first carriage and projected onto the photosensitive member through the lens. Conventionally, the image forming steps such as charging and exposure are normally conducted by means actuated by the copying paper as it is transported or by switch timing cam means driven at a related speed with respect to the scanning speed to actuate the charging and exposure means. In this case, the moving speed of the photosensitive member, the feeding speed of the copying paper and the driven speed of the cam means normally remain the same regardless of the magnification copying ratio and accordingly, the timing at which the charging and exposure means are actuated and the timing at which the scanning means pass through the reference point of the original would become different. This, in other words, will result in the failure in coincidence of the leading end of the original with the leading end of the copying paper, that is, the image will not be properly formed on the copying paper. A similar problem is encountered in a copier with magnification means in which the original holder scans with the optical means being stationary.

Accordingly, if the random cutting mechanisms such as those disclosed in U.S. Pat. No. 3,651,727 and No. 3,614,220 are utilized in the afore-described copiers, the problems are encountered that not only that the copying paper cannot be cut into the size of the original but also the copying paper is not cut into the length of the reproduced image if copies at different copying ratios are to be obtained. This is true even if the means for correcting the timing of the paper feed is provided since the scanning speed for the original would vary in accordance with the magnification power at which the copying is performed. Thus, there has not been conventionally available in a photocopying machine of the above types a roll paper cutting device which cuts the copying paper into a size of image formed thereon when copying at other than a 1:1 copying ratio.

SUMMARY OF THE INVENTION

Accordingly, it is a primary object of the present invention to provide an improved electrophotographic copying apparatus with magnification means utilizing roll type copying paper.

Another object of the present invention is to provide a novel roll paper cutting means in a copying apparatus which cuts the copying paper in accordance with the length of the original when at 1:1 copying ratio and in accordance with the size of the reproduced image when at other than 1:1 copying ratios.

Still another object of the present invention is to provide a novel slit exposure type copying apparatus with magnification means which cuts the roll storaged type paper into the length of the reproduced image.

It has been found that the aforesaid and other related objects of the present invention may be attained in an electrophotographic copying apparatus which is capable of reproducing copies at various copying ratios in which a novel means for actuating the paper cutter is provided which effects the cutting of storage roll withdrawn copying paper into lengths of the reproduced images in accordance with the copying ratio at which the copying is performed.

For a fuller understanding of the nature and objects of the present invention, reference is made to the following detailed description taken in conjunction with the accompanying drawings.

BRIEF DESCRIPTION OF THE DRAWINGS

Before the description of the present invention, it should be noted that like parts are designated by like reference numerals throughout the drawings.

DESCRIPTION OF THE PREFERRED EMBODIMENTS

Figure 1:
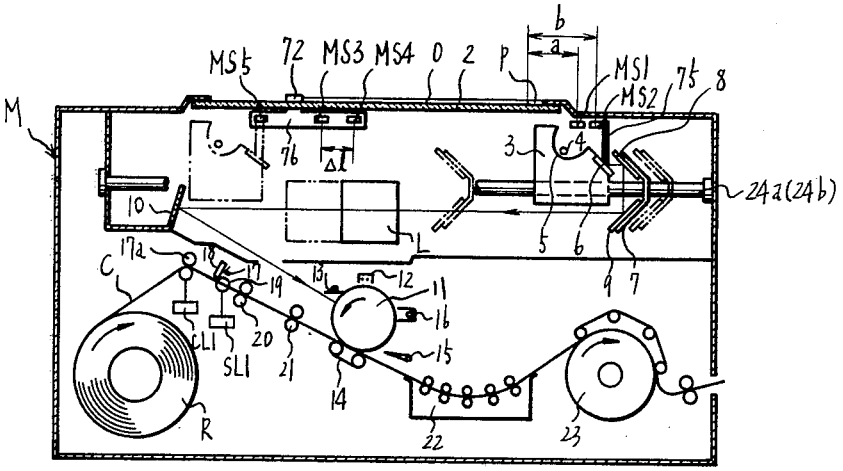
FIG. 1 is an over-all medial longitudinal cross-sectional view of a copying apparatus utilizing the roll paper cutting device of the present invention.

Referring now to FIGS. 1 to 4 of the drawings and more particularly to FIG. 1 showing the electrophotographic copying apparatus in accordance with the present invention, the apparatus M includes an original holder table 1 having a transparent glass 2 onto which an original 0 to be copied is placed, the details of which will be described hereinafter. Below the table 1, an optical scanning means which includes a first movable carriage 3 having an exposure lamp 4 backed by a reflector member 5 and a first reflector or mirror 6, a second movable carriage 7 having a second and third reflectors or mirrors 8, 9, a projection lens L and a fixed reflector or mirror 10 are provided to scan and to project the image of the original onto a rotatable photosensitive member or drum 11. As will be more fully described hereinafter, the first carriage 3 is moved at twice the speed of the second carriage 7 parallel to the original on the table 1 to keep the optical length between the original 0 and the photosensitive member 11 always constant. Thus, as the image of the original is projected successively by the scanning movements of the carriages 3, 7, the image is projected onto the photosensitive member 11 through the lens L and the fixed mirror 10 to form an electrostatic latent image on the photosensitive member 11.

About and around the photosensitive member 11, a corona-charging means 12 for charging the photosensitive member 11, an exposure slit 13 through which the projected image passes, an image transferring means 14 for transferring an electrostatic latent image onto a copying paper C the details of which are described in U.S. Pat. No. 3,824,012, a stripping member 15 for separating the copy paper and an erasing means 16 for erasing the residual charges from photosensitive member 11 are provided sequentially in the rotational direction of the photosensitive member 11.

The copy paper C is in the form of a roll R with the immediate withdrawn portion thereof being normally held in a nipped condition by a pair of intermittently driven feed rollers 17*a* connected to a feed clutch CL1. The copying paper C has its leading edge at a cutter 17 having a fixed blade 18 and a rotatable blade 19 connected to a solenoid SL1 and fed from there to the image transferring means 14 by plurality of pairs of transporting rollers 20, 21. As the latent image on the photosensitive member 11 is transferred onto the copying paper C, the paper is separated by the stripping member 15 and developed by a developing means 22 and thereafter the developed image is heat fixed by a fusing means 23 and discharged out of the apparatus.

Referring back to the optical scanning means which is employed in the present invention, the apparatus of FIG. 1 is provided with a magnification means which provides copying at first and second copying magnification ratios so as to obtain a normal 1:1 size copy (i.e., to obtain a copy of the same size as the original) at a first copying ratio and to obtain a reduced sized copy of, for example, 1:0.708 at a second copying magnification ratio. As well known from U.S. Pat. No. 3,614,222, the second carriage 7 as well as the projection lens L can be shifted a predetermined distance precedent to a copying operation at a second copying ratio and in addition, the velocities of the carriages 3, 7 must accordingly be changed. More specifically, if $n$ is termed as the magnification power (such as 0.708 power) at which the reproduced image at a second copying ratio is to be obtained, $f$ as the focal length of projection lens L, $v_1$ as the velocity of the first carriage 3 at the first copying ratio, $v_2$ as the velocity of the first carriage 3 at the second copying ratio, $x$ as the distance at which the lens L must be shifted and $y$ as the distance at which the second carriage 7 must be shifted, the velocity of the carriage and the positions of the second carriage 7 and the lens should be adjusted in accordance with the following equations in which:

$$v_2 = v_1/n$$

$$x = f(1-n) \text{ and}$$

$$y = f(1-n)^2/2n$$

Thus, in the apparatus of FIG. 1, the lens L and the second carriage 7 are shifted for the distance of $x$ and $y$ respectively to the positions shown in dotted lines and the scanning speed of the first carriage 3 (the second carriage 7 simply following the movement of the first carriage 3 at half the speed) is changed to $v_1/n$ for obtaining a copy at the second copying ratio.

Figure 2:
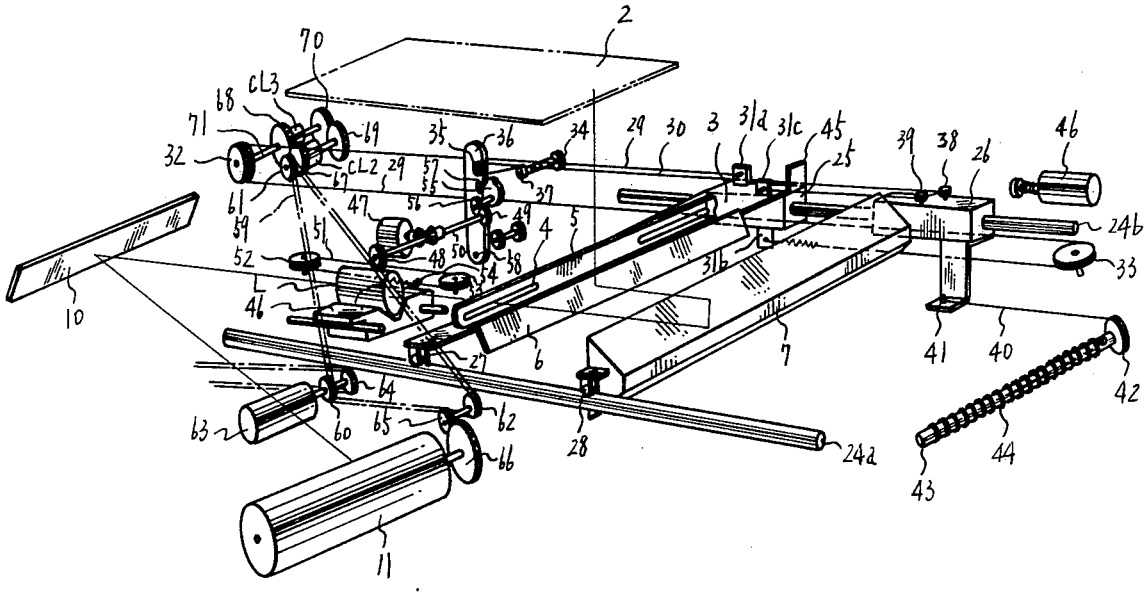
FIG. 2 is a detailed perspective view of the copying apparatus of FIG. 1.

More specifically, as shown in FIG. 2, the first and second carriages 3, 7 are movably supported on a pair of guide rods 24*a*, 24*b* by sliding members 25, 26 at one end and by bearing members 27, 28 at the other end for parallel movement with respect to the original holder table 1.

The first and second carriages 3, 7 are made movable at a 1:½ speed ratio by the first and second cables 29, 30 wherein the first cable 29 having one end fixed to a retaining member 31*a* on the sliding member 25 of the first carriage 3, extends therefrom to and around a drive pulley 32, and extending straight to and around a guide pulley 33 and back to the first carriage 3 where its end is anchored to another retaining member 31*b* provided at the bottom portion of the sliding member 25. The second cable 30, on the other hand, has one end fixed to an adjustable knob shaft 34 and extends therefrom to and around a carriage shifting pulley 35 provided on a ratio changing lever 36, along a second guide pulley 37 provided on the same axis as the knob shaft 34, and around a third and fourth pulleys 38, 39 fixed on the sliding member 26 of the second carriage 7 and to the first carriage 3 where its other end is anchored to a retaining member 31*c* provided at the top of the sliding member 25.

The optical scanning means as shown in FIG. 2, further includes a third cable 40 one end of which is connected to a retaining member 41 provided on the sliding member 26. The third cable is adapted to be wound by a return pulley 42 having integral therewith a spring shaft 43 carrying a spring 44. The spring 44 enables or biases the carriages 3, 7 to return automatically upon completion of a scan movement. The sliding member 25 of the first carriage 3 has a stop 45 which contacts with a bumper 46 in its return movement to stop the movement of carriages.

For shifting the positions of the projection lens L supported by a lens carriage 46 and the second cariage 7 carrying mirrors 8, 9 for the distances $x$ and $y$ respectively precedent to a copying operation to obtain a copy at a second copying ratio, there is provided a lens motor 47 for driving a lens drive pulley 48 and a carriage positioning gear 49 through a shaft 50. The lens drive pulley 48 is in engagement with a lens drive cable 51 which is in an endless form about a pair of pulleys 52, 53. The cable 51 engages an arm 54 projecting into the path of cable 51 from the lens carriage 46 so that the lens L is moved when the cable 51 is advanced.

The carriage positioning gear 49 driven by the lens motor 47 is adapted to rotate a carriage shifting cam 55 having two cam surfaces of different radii through a cam driving gear 56. The first cam surface of the cam 55 is normally in engagement with a cam follower 57 provided on the ratio changing lever 36 and holds the lever 36, which is swingable about an axis 58, in the position shown in FIG. 2 when the copying magnification ratio is 1:1. Upon energization of the lens motor 47, the lens carriage 46 is shifted the distance $x$ by the cable 51 and simultaneously, the carriage shifting cam 55 is rotated. This causes the cam follower 57 to disengage from the first cam surface of the cam 55 to enable the ratio changing lever 36 to swing clockwise about the axis 58. The pivotal movement of the lever 36 shifts the position of the carriage shifting pulley 35 and accordingly causes the second carriage 7, which is connected with the pulley 35 through the second cable 30, to shift from its position the distance $y$. The swinging movement of the ratio changing lever 36 is terminated by a stop 58*a* when its side edge contacts therewith.

To drive the first and second carriages, 3, 7 at the speeds suited for the selected copying ratio, the drive means includes a triple stage speed changing means for driving the carriage at the first velocity $v_1$ during the 1:1 copying ratio in the first stage, for driving the carriage at the second velocity $v_2$ (i.e., $v_1/0.708$) during 1:0.708 copying ratio in the second stage, and for the speed changing means to be in a third neutral stage during the return of the carriages.

As specifically shown, a timing belt 59 wound over first, second and third pulleys 60, 61, 62 is driven by a main motor 63. The first pulley 60 has on a same shaft a paper feeding pulley 64 for transporting the copying paper C and the third pulley 62 has on a same shaft a gear 65 which in turn meshes with another gear 66 for driving the photosensitive drum 11. The second pulley 61 includes on its shaft a first drive gear 67 in mesh with a second drive gear 68, an electromagnetic reduction clutch CL2 and a third drive gear 69 in mesh with a fourth drive gear 70 on the shaft 71. The shaft 71 also includes another electromagnet clutch CL3 with its end holding the drive pulley 32. Thus, when the electromagnetic clutch CL3 is energized with the other clutch CL2 deenergized, the first and second carriages 3, 7 respectively move at the velocities of $v_1$ and $\frac{1}{2}v_1$ to obtain a copy of 1:1 magnification ratio. On the other hand, when the reduction clutch CL2 is energized, the drive pulley 32 is rotated at a different speed to move the carriages at the velocities of $v_2$ (i.e., $v_1/n$) and $\frac{1}{2}v_2$ to obtain a copy of 1:$n$ magnification ratio.

Figure 3:
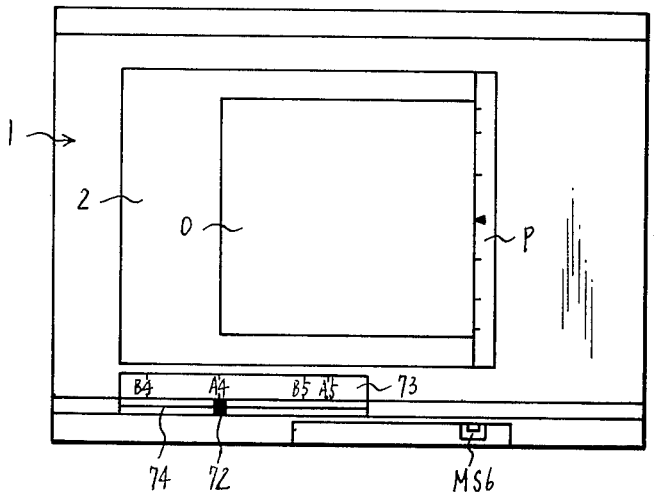
FIG. 3 is a top plan view of an original holder of the copying apparatus of FIG. 1 on which an original to be copied is placed.

Referring now to FIG. 3, the original holder table 1 includes a reference edge member P at one end of the transparent glass 2 for aligning an end of the original 0 with the edge thereof. Along the other side end of the transparent glass, there is provided a slidable indicator or indexing member 72 for alignment with the other end of the original 0. A scale 73 indented with plurality of most often used paper size marks is provided adjacent the path of the indicator member 72. The indicator member 72 is slidable along a groove 74 and as shown aligned with the end of original 0. In accordance with the present invention, the alignment of the indicator member 72 with the end of original 0 enables the copy paper to be cut into a length of reproduced image i.e., the paper will be cut to a length corresponding to a length of the original when a copy is to be made at the first copying ratio of 1:1 and to a length corresponding to a length of a reproduced image when a copy is to be made at a second copying ratio of other than 1:1.

If $L_1$ is considered as the length of the copying paper cut to the length corresponding to the length of the original with said indicator member aligning with the end of the original when at a 1:1 copying ratio, and $L_2$ as the length to which the copying paper must be cut to obtain the length equaling to a length of a reproduced image when at a second copying ratio with a magnification of $n$, then $L_2=nL_1$. To satisfy this condition, a paper feed initiation means must be provided to control the initiation of paper feeding for the first and second copying ratios respectively. In other words, the paper feeding must be initiated at different points in time for copying at a first copying ratio and at a second copying ratio. This is so since the scanning speeds of the carriages differ for different copying ratios. To be more specific, the location of the leading edge of the copying paper along its path must always be at the same location at the initiation of image exposure, i.e., at the initiation of the scan of the leading edge of the original on the table 1 by the first carriage in order for the copy paper to be properly formed with image.

Referring to FIG. 1, the paper feed initiating switches MS1, MS2 are fixedly provided at the upper portion of the apparatus M. Both switches MS1, MS2 are adapted to be actuated by an actuator rod 75 projecting from and provided integrally on the first carriage 3. The first switch MS1 is for energizing the paper feed clutch CL1 when a copy is to be obtained at first copying ratio and the second switch MS2 is for energizing the same when a copy is to be obtained at second copying ratio.

Figure 4:
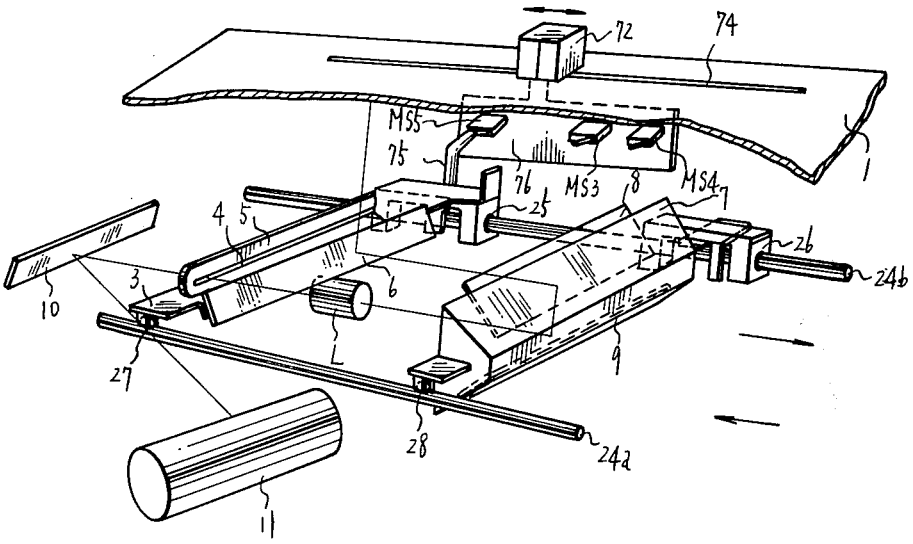
FIG. 4 is a simplified partial perspective view of the copying apparatus of FIG. 1 showing the slidable indicator member with corresponding switches.

The switch means for actuating the solenoid SL1 of the cutter 17 to cut the copying paper C is provided on a switch board 76 integrally movable with the slidable indicator member 72. As shown in FIGS. 1 and 4, the switch board 76 fixed to the indicator member 72 includes a first cutter actuating switch MS3, a second cutter actuating switch MS4 and a return initiating switch MS5. The first cutter actuating switch MS3 is related with the first paper feed initiating switch MS1 and is for actuating the cutter 17 to cut the copying paper into the length of the original at first copying ratio, i.e., it cuts the paper into the length of $L_1$ as described above. The second cutter actuating switch MS4, on the other hand, is related with the second paper feed initiating switch MS2 and is for cutting the copying paper at the second copying ratio (i.e., it cuts the paper into the length of $L_2$. These switches MS3, MS4 are separated by the distance of $\Delta l$ which will be described hereinafter. Finally, the return initiating switch MS5 is for returning the first and second carriages 3, 7 to their original positions. Each of these switches MS3, MS4 and MS5 are actuated by the actuating rod 75 of the first carriage 3 as it passes by the respective switches.

The locations of the first and second paper feed initiating switches MS1, MS2 are determined in reference to the leading edge of the original in contact with reference edge member P (FIG. 3). That is, these switches are located at the distances of $a$ and $b$ respectively from the one end of the original on the table 1 with its end aligned with the edge of reference edge member. These distances $a$ and $b$ are determined by subtracting a first distance E which equals the peripheral surface distance of the photosensitive member 11 from the exposure station where the exposure slit 13 is provided to the image transferring station where the image transferring means 14 from a second distance D which equals to the path distance from where the leading edge of the copy paper is at the initiation of paper feed to the image transferring station where the image transferring means 14 is provided and dividing the difference of D minus E by the magnification powers set for first and second copying ratios. To be more specific, the distance D equals to the distance from the cutter 17 where the leading edge of the copying paper is at the initiation of paper feed to the image transferring means 14 where the leading edge of the copying paper coincides with the leading edge of an electrostatic latent image formed on the photosensitive member 11. The distance E, on the other hand, equals to the peripheral surface distance along the photosensitive member 11 from a leading edge of a latent image formed at where the exposure slit 13 is to where the leading edge of the latent image coincides with the leading edge of the copy paper for image transfer at the image transferring station where the image transferring means 14 is provided.

If F is assumed to be the difference of D and E thus obtained, then the locations of the switches MS1 and MS2 would be determined by dividing F by the magnification powers set for the first and second copy ratios. Thus, if the magnification power for the first copying ratio is $n_1$ and $n_2$ for the second copying ratio, the first paper feed initiating switch MS1 would be located at the distance of $F/n_1$ which is $a$ away from the leading edge of the original in contact with the reference edge member P and the second paper feed initiating switch MS2 would be located at the distance of $F/n_2$ which is $b$ away from the leading edge of the original. If $n_1$ equals to one as is normally so, then the distance of $a$ would simply equal to F. As to the distance between these switches MS1 and MS2 it would simply equal to $F/n_1 - F/n_2$ or $F - F/n_2$ if $n_1$ is one. It should be noted that if $n_2$ is less than 1, the switch MS2 is located to the right of MS1 and if $n_2$ is larger than 1, MS2 will be located to the left of MS1.

The locations of the first and second cutter actuating switches MS3 and MS4 are, as apparent, simply separated the distance of said $\Delta l$ which equals to the distance between the first and second paper feed initiating switches MS1, MS2. Thus the distance of $\Delta l$ would equal to $F/n_1 - F/n_2$ or $F - F/n_2$ if $n_1$ is 1. In this way, the distance between the first paper feed initiating switch MS1 and the first cutter actuating switch MS3 would always equal to the distance between the second paper feed initiating switch MS2 and the second cutter actuating switch MS4. This assures, as this distance equals to the length of the original, the copying paper to be cut into a length of original at 1:1 copying ratio and to the length of the reproduced image at a copying ratio other than 1:1. In this regard, the switches MS3, MS4 are respectively displaced from the indicator as shown in FIGS. 1 and 4.

The conditions of $a = F/n_1$ and $b = F/n_2$ are particularly true if the afore-described distances of D and E differ. But if D equals to E, then the first and second paper feed initiating switches MS1, MS2 may be made into one switch and be provided immediately below the leading edge of the original. For the same reason, the cutter actuating switches MS3, MS4 may be made into one switch and provided immediately below the indicator member 72.

In operation, an original 0 to be copied is placed on the transparent glass 2 of the table 1 with one end aligned in contact with the reference edge member P. The slidable indicator member 72 is then slid along the side of the original for alignment with the other end of the original. The switch board 76 is integrally moved with the indicator member 72.

Figure 5A:
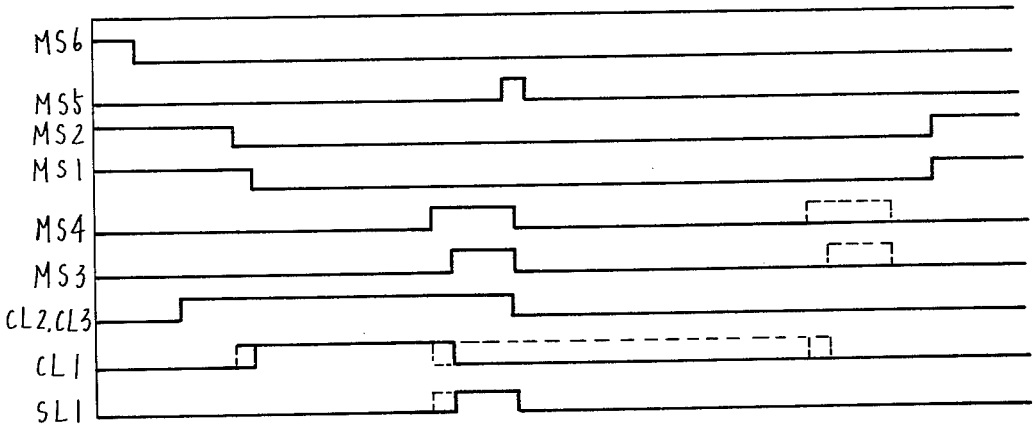
FIGS. 5A and 5B are time sequence charts for the copying apparatus of FIG. 1 showing operational sequences of the roll paper cutting device.

If the copying at the first copying ratio, i.e., at 1:1 copying is desired, the projection lens L and the second carriage 7 would be at the solid line positions shown in FIG. 1. Upon pressing of the print switch MS6 as shown in FIG. 5A, the electromagnetic clutch CL3 together with the main motor 63 are energized causing the timing belt 59 to be driven to rotate the photosensitive drum 11 through the gears 65, 66. The energization of the clutch CL3 rotates the drive pulley 32 and moves the first and second carriages 3, 7 at the speeds of 1 to ½ by means of the first and second cables 29, 30.

At the very beginning of the movement of the first carriage, the actuator rod 75 thereof at first actuates the second paper feed initiating switch MS2 but nothing happens as the desired copying ratio selected is first copying ratio of 1:1. As the carriage 3 moves, the actuator rod 75 actuates the first paper feed initiating switch MS1 and this energizes the feed clutch CL1 for the intermittently driven feed rollers 17a. Accordingly, the copy paper C where its leading edge is at the cutter 17 is fed along the path to the image transferring means 14 in synchronism with the speed of the first carriage 3. As the first carriage 3 moves, it scans the image of the original 0 and projects its scanned image from the first mirror 6 on the first carriage 3 to the second and third mirrors 8 and 9 on the second carriage 7. The image is further projected through the lens L and the fixed mirror 10 and onto the photosensitive member 11 through the exposure slit 13 for forming a latent image thereon of successively scanned sections of the original.

Upon further movement of the first carriage 3, the first cutter actuating switch MS3 (the second cutter actuating switch MS4 is non-operative although actuated) is actuated by the actuator rod 75 and this energizes the solenoid SL1 for the cutter 17 and cuts the copy paper C into the length corresponding to the length of the original. The actuation of the switch MS3 simultaneously deenergizes the feed clutch CL1 to stop the feeding of the copy paper C. The further movement of the carriage 3 causes the return initiating switch MS5 to be actuated by the actuator rod 75 and this deenergizes the clutch CL3. The carriages 3, 7 are thus returned to their initial positions by the action of spring 44. The copy paper, on the other hand, passes through the image transferring means 14 where the latent image is transferred thereto and fed further through the developing means 22 and the fusing means 23 and fed out of the apparatus.

If a copy at the second copying ratio, for example, a reduction copy of 1:0.708 is desired, the lens L and the second carriage 7 are respectively shifted for the distances of $x$ and $y$ precedent to the copying operation. Upon pressing of the print switch MS6 to initiate the copying cycle, the electromagnetic reduction clutch CL2 is energized to drive the drive pulley 32 to initiate the movement of the carriages 3, 7. At this time, the scanning speeds of the carriages 3, 7 are respectively 1/0.708 or $1/n$ th the speeds of carriages at the first copying ratio of 1:1. Immediately following the movements of the first and second carriages 3, 7, the actuator rod 75 of the first carriage 3 actuates the secondpaper feed initiating switch MS2 and this in turn energizes the feed clutch CL1 to initiate the feeding of the copy paper C. Thus, the copy paper is fed along the path and the scanning movements of the carriages 3, 7 project the image onto the photosensitive drum 11 successively. As the carriage 3 moves, the actuator rod 75 thereof actuates the second cutter actuating switch MS4 to deenergize the feed clutch CL1 and simultaneously energizes the solenoid SL1 to actuate the cutter 17. Thus, the copy paper C is cut into a length corresponding to the length of the reproduced image. That is, if the copy was to be obtained at 1:0.708 ratio, the paper will be cut to the length of 0.708th the length of the original.

The further movement of the carriage causes the return initiating switch MS5 to become actuated by the actuator rod 75 and this deenergizes the reduction clutch CL2 to enable the carriages to return to their initial positions. The copying paper, on the other hand, is fed through the image transferring means 14 where its leading edge coincides with the leading edge of the latent image formed on the drum 11. The paper further is fed and discharged out of the apparatus.

Figure 5B:
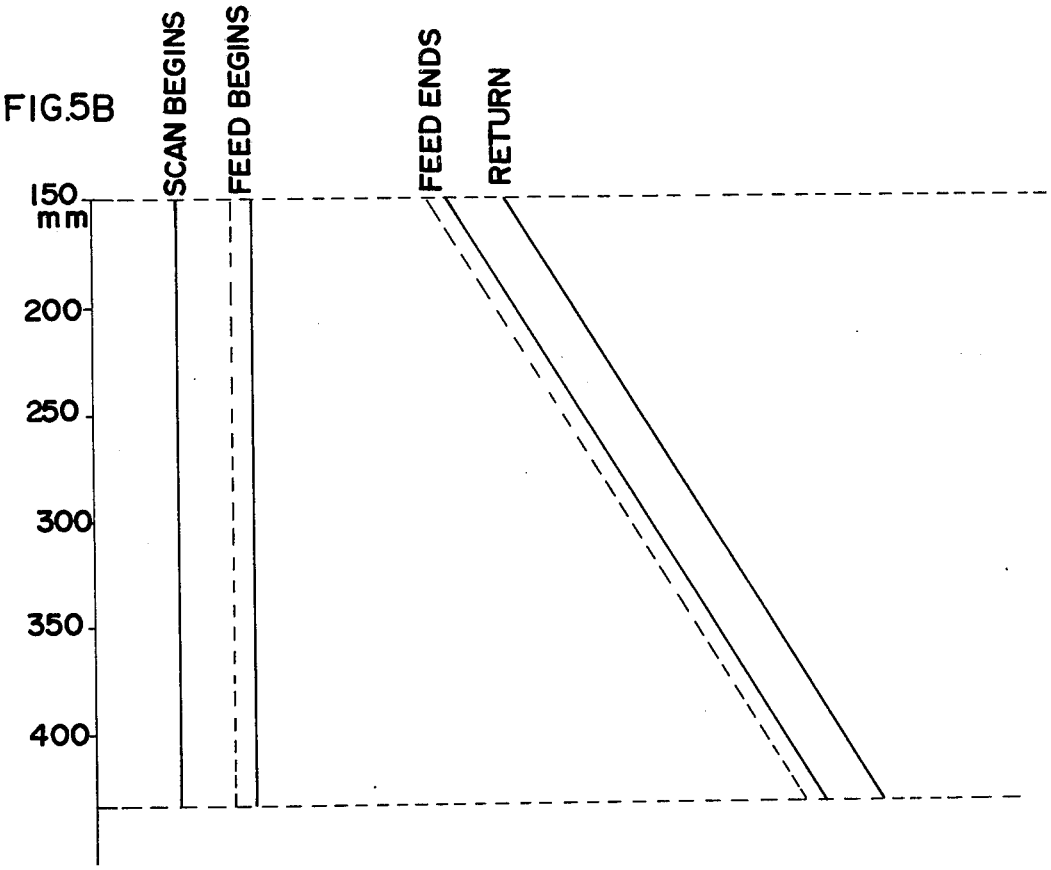

It should be noted that the sequence chart of FIG. 5B is merely indicative of FIG. 5A and shows that the feeding of paper begins and ends at different points in time for first and second copying ratios. The paper may be cut to any length between about 150mm and 430mm depending upon the position of the indicator member aligned with the end of the original.

While the conditions for the locations of the paper feed initiating switches MS1, MS2 and the cutter actuating switches MS3, MS4 set forth above have been described for the image transfer type copier as that shown in FIG. 1, it should be noted that substantially the same conditions apply for electrofax type copier in which a latent image is formed directly on the copying paper. In such electrofax copier, the afore-described distance of D would equal to the distance from the cutter where the leading edge of the paper is at to an exposure station and the distance E would equal to zero. Thus, switches MS1 and MS2 are respectively provided at the distances $D/n_1$ or D if $n_1$ equals to 1 and $D/n_2$ from the leading edge of the original on the table 1.

Figure 6:
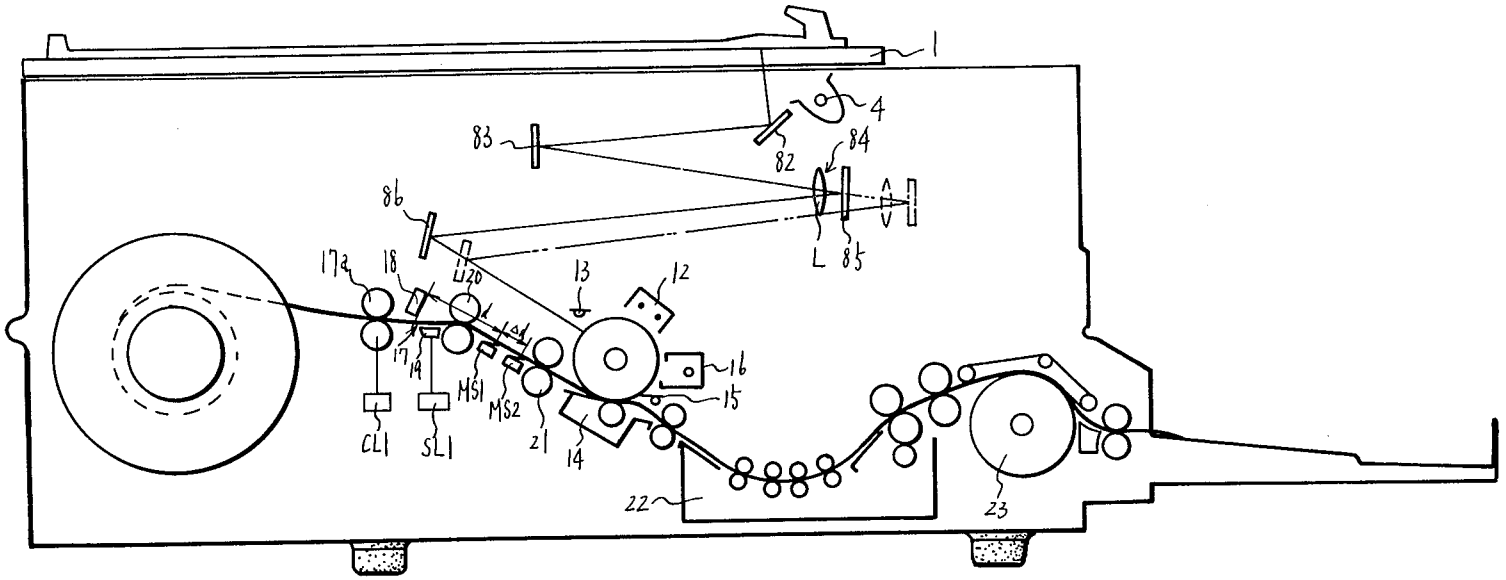
FIG. 6 is an overall view similar to FIG. 1 of another copying apparatus in accordance with a second embodiment utilizing the roll paper cutting device of the present invention.
Figure 7:
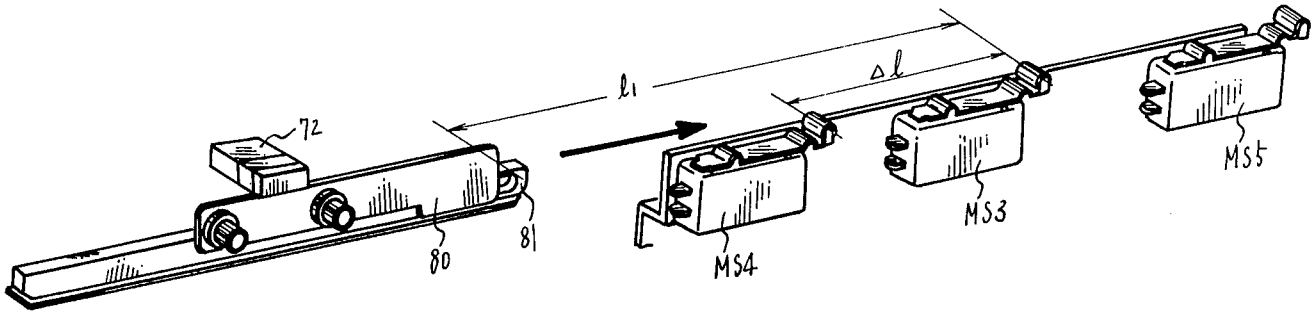
FIG. 7 is a partial perspective view of the roll paper cutting device for the copying apparatus of FIG. 6.
Figure 8:
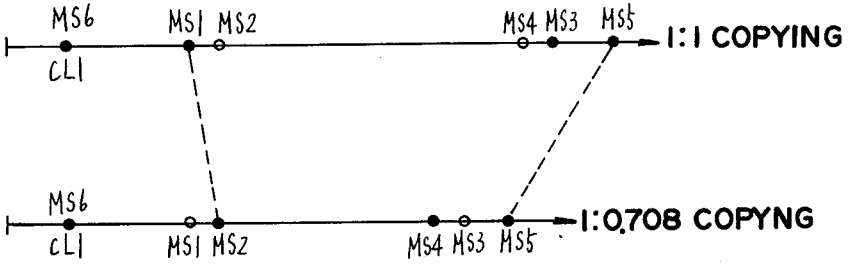
FIG. 8 is a time sequence charge for the copying apparatus of FIG. 6 showing the operational sequence of the roll paper cutting device.

Referring now to FIGS. 6 to 8 which illustrate a second embodiment of the present invention, FIG. 6 shows an exposure slit type electrophotographic copying apparatus M in which the reference numeral 1 designates a reciprocatingly movable original holder table. The table 1 includes substantially the same means as that shown in FIG. 3 and includes the transparent glass 2, the reference edge member P and the slidable indicator member 72 in the similar manner as in the previous embodiment. As shown in FIG. 7, the slidable indicator member 72, which is to be aligned with an end of the original 0, includes an integral lever member 80 carrying a switch actuating rod 81. Along the path of the switch actuating rod 81, there are provided on the frame of the apparatus a second cutter actuating switch MS4, a first cutter actuating switch MS3 and a return initiating switch MS5. These switches are adapted to be actuated by the switch actuating rod 81 as the table 1 performs the scanning movement in the direction to the right as viewed in FIG. 6. It is to be noted that the first and second cutter actuating switches MS3, MS4 are separated by the distance of $\Delta$ 1 and are for actuating the solenoid SL1 for the cutter 17 to cut the copy paper C into a length corresponding to first and second copying ratios respectively. The return initiating switch MS5 is for returning the table 1 to its initial position.

Disposed below the table 1 are an exposure lamp 4, a first reflector mirror 82, a second reflector mirror 83, a lens mirror 84 consisting of lens L and a mirror 85 and a third mirror 86. It should be noted that the lens mirror 84 and the third mirror 86 are shiftable between first and second positions in which both are in first positions (solid lined positions) at a first copying ratio for obtaining a reproduced copy at a 1:1 ratio and shifted to second positions (dotted lined positions) at a second copying ratio for obtaining a copy at for example 1:0.708 ratio. Thus the lens mirror 84 and the third mirror 86 are shiftable for predetermined distances respectively as is well known to those skilled in the art. It should be further noted that the scanning speeds of the table 1 are different at the first and second copying ratios respectively and for this purpose, the drive means for the table 1 includes a first and second clutch means CL2 and CL3 (not shown) for moving the table at a speed of $v_1$ for the first copying ratio of 1:1 and at a speed of $v_2$ (which equals to $v_1/n$) for second copying ratio of $1:n$.

The remaining elements such as the photosensitive drum 11 and its related means and the means provided along the path of copy paper C are substantially identical to those of the previous embodiment and accordingly the description thereof will be omitted herein.

The primary difference of this embodiment from that first described is that the copy paper C is initially fed prior to the commencement of the scanning movement of the table 1 and then the table 1 is initiated for scan when the leading edge of the paper reaches a predetermined location along its path. For this purpose, a first and second table scan initiating switches MS1 and MS2 are provided along the path of the copying paper for actuation by the leading edge of the paper. The first switch MS1 is for initiating the scan movement of the table 1 at the velocity $v_1$ when a copy is to be obtained at the first copying ratio and the second switch MS2 is for initiating the scan movement of the table 1 at the velocity $v_2$ when a copy is to be obtained at the second copying ratio.

To determine the distance of Δ 1 which is the distance between the first and second cutter actuating switches MS3 and MS4 for locating the positions thereof, under the following conditions in which the first table scan initiating switch MS1 is located at the distance $d$ from the cutter where the leading edge of the copy paper is at the initiation of copying operation and the second table scan initiating switch MS2 is located at the distance of $d + \Delta d$ from the cutter where the leading edge of the paper is positioned. Thus, the distance $d$ may be regarded as the length of copy paper C which is fed prior to the commencement of the movement of the table 1 at the first copying ratio and the distance of sum of $d$ and $\Delta d$ may be regarded as the length of copy paper which is fed prior to the commencement of the movement of the table 1 at the second copying ratio. And if $l_1$ is the distance from the tip of switch actuating rod 81 to the first cutter actuating switch MS3 when the table 1 is in rest position as shown in FIG. 6, which in other words equals to the length of copy paper fed from the initiation of scan movement of the table 1 until the actuation of the first cutter actuating switch MS3 at the first copying ratio, then the length $L_1$ to which the copy paper is to be cut at the first copying ratio of 1:1 equals to the sum of $d$ and $l_1$ as the paper is fed at the same speed as the table 1. That is:

$$L_1 = d + l_1$$

When a copy at the second copying ratio of 1:$n$ is to be obtained wherein $n$ is the magnification power, then the length $L_2$ to which the copy paper is to be cut at the second copying ratio equals to:

$$L_2 = (d + \Delta d) + n \cdot (l_1 - \Delta 1)$$

wherein $(d + \Delta d)$ is equal to the length of copy paper which is fed prior to the commencement of the movement of the table 1 and $n(l_1 - \Delta l)$ is equal to the length of copy paper fed from the initiation of the scan movement of the table 1 until the actuation of the second cutter switch MS4 (which is located at the position of $l_1 - \Delta l$). The multiplication of $(l_1 - \Delta l)$ by $n$ which is the magnification power is necessary as the table 1 scans at the speed of $1/n$th the speed of the table 1 at first copying ratio.

Thus as $L_2 = n \cdot L_1$, then $d + \Delta d + n1_1 - n\,\Delta l_1 = nd + nl_1$ and therefore $\Delta\, l = (d + \Delta d - nd)/n$ Accordingly, the first and second cutter actuating switches MS3 and MS4 are separated by the distance $(d + \Delta d - nd)/n$ and these switches are so accordingly located. Thus, as long as the conditions set forth above are met and provided that the slidable indicator member 72 is aligned with one end of the original to be copied, the copy paper C will be cut to the length corresponding to the length of the original at the first copying ratio of 1:1 and will be cut to the length of $n$th the length of the original at second copying ratio of 1:$n$.

In operation, an original to be copied is placed on the transparent glass 2 with its one end in contact with the reference edge member P and then the indicator member 72 is slid along the original for alignment with the other end of original as shown in FIG. 3. If a copy is to be obtained at second copying ratio of, for example, 1:0.708, the lens mirror 84 and third mirror 86 are shifted respectively to the positions shown by dotted lines.

Upon actuation of print switch MS6, the feed clutch CL1 for the intermittently driven feed rollers 17*a* is energized as shown in FIG. 8. The copy paper C, where its leading edge is at the cutter 17, is accordingly fed at a constant velocity. As the leading edge of the copy paper C reaches the first table scan initiating switch MS1 and if the first copying ratio of 1:1 has been selected, it actuates this switch MS1 energizes the first clutch CL2 to initiate the scan movement of the table 1 in the direction to the right as viewed in FIG. 6. The speed of the movement of table 1 is at the same speed as the feeding speed of the paper (i.e., at the speed of $v_1$ as explained above).

If, on the other hand, the second copying ratio of, for example, 1:0.708 has been selected for copying, the switch MS1 is non-operative although actuated by the copying paper. The further feeding of copy paper causes the second table scan initiating switch MS2 to become actuated by the leading edge of paper. This energizes the second feed clutch CL3 to initiate the scan movement of the table at the speed of $1/n$ th the speed of the table 1 at first copying ratio. At either copying ratio, the table 1 is initiated for scan movement and projects an image of the original onto the rotating photosensitive drum 11 through the first and second reflector mirrors 82 and 83, the lens mirror 84 consisting of lens L and mirror 85 and the third mirror 86. As the table 1 moves, the switch actuating rod 81 carried by the lever member 80 connected to the indicator member 72 which is moved integrally with the table 1 reaches the second cutter actuating switch MS4 and actuates it if the second copying ratio had been selected. The actuation of the switch MS4 energizes the solenoid SL1 for the cutter 17 and simultaneously deenergizes the feed clutch CL1 to stop the feeding of copy paper by the feed rollers 17*a*. The actuation of switch MS4 cuts the copy paper into a length of 0.708th the length of the original.

If the first copying ratio has been selected, the switch MS4 is non-operative and instead, the first cutter actuating switch MS3 is actuated by the switch actuating rod 81 upon further movement of the table 1. The actuation of the switch MS3 similarly energizes the solenoid SL1 for the cutter 17 and deenergizes the feed clutch CL1 to cut the copy paper C into a length corresponding to the length of the original. As the table 1 moves further, the return initiating switch MS5 is actuated by the switch actuating rod 81 and the table 1 then makes the return movement to its initial position of FIG. 6. The copy paper C cut by the cutter 17 continues to be transported through the image transferring means 14, the developing means 22 and the fusing means 23 and is discharged from the apparatus.

While the second embodiment had been described in connection with the image transfer type copier, it should be noted that the conditions for the locations of various switches set forth above are applicable to an electrofax type copier such as that shown in U.S. Pat. No. 3,614,220 or U.S. Pat. No. 3,424,526.

In addition, the apparatus of FIG. 6 may be provided with first and second paper feed initiating switches for actuation by the switch actuating rod 81 instead of said first and second table scan initiating switches as in the first embodiment so that the feed of paper is initiated by the movement of table although such mode is unlikely as the amount of movement of the table would be quite large.

Furthermore, in connection with the first embodiment, the first and second table scan initiating switches MS1 and MS2 of the second embodiment may be provided along the path of the copy paper in the apparatus of FIG. 1 instead of paper feed initiating switches. In this case, the table scan initiating switches MS1 and MS2 will be respectively provided at distances $d$ and $d + \Delta d$ from the cutter wherein the distances are the length of copy paper fed prior to the scanning movement of carriages 3 and 7 at the first copying ratio and the distance $d + \Delta d$ as the length of copy paper fed prior to the commencement of the movement of carriages at the second copying ratio. Then the distance $\Delta l$, which is the distance to be maintained between the first and second cutter actuating switches MS3 and MS4 which are provided on the switch board 76 of the indicator member 72 for actuation by actuating rod 75, would be $(d+\Delta d-nd)/n$ as apparent from the foregoing description. It should be noted that this condition is applicable for both the image transfer type and electrofax type copiers.

In addition, it should be understood that the locations of respective switches described in the first embodiment are particularly correct provided that the optical axis of the first carriage extending from the original to the first mirror 6 coincides with the position of switch actuating member 75. However if the member 75 is provided at the position displaced from the optical axis, then the locations of switches must be determined with its displacement taken into consideration. Accordingly, what must be regarded as the most important feature of the present invention are that the switch MS-1 is actuated when the center of optical axis is at the distance of "$a$" from the reference edge of the original and the switch MS-2 is actuated when the center of the optical axis is at the distance of "$b$" from the reference edge of the original. Thus, depending on the position of the member 75 provided on the first carriage, the switches MS-1 and MS-2 may be made into single switch with switches MS-3 and MS-4 made similarly into single switch and still satisfying the above conditions.

Having described the invention in connection with certain specific embodiment thereof, it is to be understood that further modifications may now suggest themselves to those skilled in the art and it is intended to cover such modifications as fall within the scope of the appended claims.

We claim:

1. An electrophotographic copying apparatus utilizing a roll type storage of copy paper and having selective first and second image magnification copying ratios comprising:

an original holder table for supporting an original to be copied;

a slidable indicator member slidable along the original for alignment with an end of the original;

means for feeding paper from said storage along a predetermined path and a cutting means along said path for cutting the copy paper;

scanning means for scanning the original at a first speed or at a second speed corresponding to said first and second copying ratios respectively;

actuating means responsive to the position of said indicator member and including a first means for actuating said cutting means at the first copying ratio and a second means for actuating said cutting means at the second copying ratio wherein said actuating means being actuated during the scanning movement of said scanning means for cutting the copying paper into a length corresponding to the length of the reproduced image at the first and second copying ratios.

2. An electrophotographic copying apparatus utilizing a roll type storage of copy paper and having selective first and second image magnification copying ratios of 1:1 and 1:$n$ respectively comprising:

an original holder table having a transparent plate for supporting an original to be copied with one end of the original aligned with a reference edge;

a slidable indicator member slidable along the original for alignment with the other end of the original;

means for feeding the copy paper from the storage along a predetermined path and a cutting means for cutting the copy paper and an image forming means for forming an image of the original are provided;

scanning means for scanning the original at a first speed for the first copying ratio or at a second speed which is $1/n$ th the first speed for second copying ratio;

actuating means related with said indicator member and including a first means for actuating said cutting means at the first copying ratio and a second means for actuating said cutting means at the second copying ratio wherein said first means is actuatable during the scanning movement of said scanning means for cutting the copy paper into a length corresponding to the length of original and said second means is actuatable during the scanning movement of said scanning means for cutting the copy paper into a length of $n$ times the length of the original.

3. A slit exposure type electrophotographic copying apparatus utilizing a roll type storage of copy paper and having variable magnification means for producing an image of an original on the copy paper at a first copying ratio of 1:1 and at a second copying ratio of 1:$n$ wherein $n$ is a magnification power other than 1 in which the reproduced image is formed at a second copying ratio comprising:

an original holder table having a transparent plate for supporting the original to be copied with one end of the original aligned with a reference edge;

a slidable indicator member slidable along the original for alignment with the other end of the original;

means for feeding copy paper from the storage thereof along a predetermined path and a cutting means for cutting the copy paper and an image forming means for forming an image of an original on the copy paper are provided located along said path, said copy paper initially having a leading edge at said cutting means and being fed therefrom;

scanning means for scanning the original at a first speed equal to the travelling speed of the copy paper for the first copying ratio and at a second speed which is $1/n$ th the speed of the first speed for the second copying ratio;

a first paper feed initiating means for initiating the operation of said feeding means for feeding the copy paper when the copy is to be obtained at said first copying ratio;

a second paper feed initiating means for initiating the operation of said feeding means for feeding the copy paper when the copy is to be obtained at said second copying ratio; and an actuating means including a first cutter actuating means for actuating said cutting means at the first copying ratio and a second cutter actuating means for actuating said cutting means at the second copying ratio;

said first paper feed initiating means commencing the feeding of the copy paper by said feeding means upon actuation thereof and said first cutter actuating means being actuated during the scanning movement of said scanning means for actuating said cutting means to cut the copy paper into a length corresponding to the length of the original when the copy is to be obtained at said first copying ratio, and said second paper feed initiating means commencing the feeding of the copy paper by said feeding means upon actuation thereof and said second cutter actuating means being actuated during the scanning movement of said scanning means for actuating said cutting means to cut the copy paper into a length corresponding to a length *n* times the length of the original.

4. The electrophotographic copying apparatus as claimed in claim 3 wherein said first and second paper feed initiating means and said first and second cutter actuating means are provided in the path of scanning movement of said scanning means for actuation by said scanning means.

5. A slit exposure type electrophotographic copying apparatus utilizing a roll type storage of copy paper and having variable magnification means for producing an image of an original on the copy paper at a first copying ratio of 1:1 and at a second copying ratio of 1:*n* wherein *n* is a magnification other than 1 in which the reproduced image is formed at the second copying ratio, comprising:

an original holder table having a transparent member for supporting the original to be copied with one end of the original aligned with a reference edge;

means for feeding the copy paper from the storage thereof along a predetermined path and a cutting means for cutting the copying paper and an image forming means for forming an image of the original located along said path, said copy paper having a leading edge initially positioned at said cutting means and being fed therefrom;

scanning means for selectively scanning the original at a first speed equal to the travelling speed of the copy paper for the first copying ratio, and at a second speed which is 1/*n*th the speed of the first for the second copying ratio;

a first scan initiating means for initiating the scanning movement of said scanning means at said first copying ratio and a second scan initiating means for initiating the scanning movement of said scanning means at said second copying ratio, and an actuating means including a first cutter actuating means for actuating said cutting means at said first copying ratio and a second cutter actuating means for actuating said cutting means at said second copying ratio;

said first scan initiating means commencing the scanning movement of said scanning means upon actuation thereof and said first cutter actuating means being actuated during the scanning movement of said scanning means for actuating said cutting means to cut the copy paper into a length corresponding to the length of the original when the copy is to be obtained at said first copying ratio, and said second scan initiating means commencing the scanning movement of said scanning means upon actuation thereof and said second cutter actuating means being actuated during the scanning movement of said scanning means for actuating said cutting means to cut the copy paper into a length corresponding to a length *n* times the length of the original.

6. The electrophotographic copying apparatus as claimed in claim 5 wherein said first and second scan initiating means are provided along the path of the copy paper for actuation thereby and said first and second cutter actuating means are provided in the path of movement of said scanning means for actuation thereby.

7. A slit exposure type electrophotographic copying apparatus utilizing a roll type storage of copy paper and having means for selectively reproducing an image of an original at a first copying magnification ratio of 1:1 and at a second copying magnification ratio of 1:*n* wherein *n* is a magnification power other than 1, comprising:

an original holder table having a transparent member for supporting an original to be copied and a reference member for aligning one end of the original therewith;

an indicator member slidable along the original for alignment with the other and of the original;

an optical scanning means disposed below said table and including a first carriage with at least a first mirror, a second carriage with at least a second mirror, and a projection lens disposed in the optical path of said mirrors, said first and second carriages being movable across the table at a speed ratio of 1:½;

means for advancing said first carriage attendant to scanning at a first speed corresponding to said first copying ratio with the second carriage following the movement of said first carriage at a half the speed thereof and at a second speed corresponding to said second copying ratio which is 1/*n*th the speed of the first speed with said second carriage following the movement of said first carriage at a half the speed of the first carriage;

means for shifting said second carriage and said projection lens between first positions and second positions wherein said second carriage and said projection lens are in said first positions at said first copying ratio and in said second positions at said second copying ratio;

a photosensitive member at the terminal end of the optical path for the projection of the image of the original thereonto and including about the surface thereof a charging means, an exposure slit means and image transferring means;

paper cutting means;

means for feeding said copy paper along a predetermined path through said cutting means and said image transferring means, said copy paper initially having a leading edge at said cutting means and being fed therefrom;

a first paper feed initiating means for initiating feeding of the copy paper by said feeding means responsive to the selection of said first copying ratio and a second paper feed initiating means for initiating feeding of the copy paper by said feeding means responsive to the selection of said second copying ratio, said first and second paper feed initiating means being provided in the scanning path of said carriage in a spaced apart relation, said first paper feed initiating means being provided at the distance difference from said one end of the original aligned with said reference edge member wherein said distance difference is the difference between the distance from said cutting means where the leading edge of the copy paper is to said image transferring means where the leading edge of the copy paper coincides with a leading edge of the image formed on said photosensitive member and the surface distance of said photosensitive member from the leading edge of the image formed at said exposure slit to where the leading edge of the image coincides with the leading edge of the copy paper where said image transferring means is provided, said second paper feed initiating means being provided at said distance difference divided by said magnification power $n$ from said one end of the original aligned with said reference member, and a first and second cutter actuating means associated with said slidable indicator member for actuating said cutting means at first and second copying ratios respectively, said first and second cutter actuating means being provided in spaced apart relation separated by the same distance as the distance between said first and second paper feed initiating means, both of said actuating means being provided in the scanning path of said carriages for actuation during the scanning movement of said carriages;

said first paper feed initiating means commencing the feeding of the copy paper upon actuation thereof and said first cutter actuating means being actuated during the scanning movement of said carriages for actuating said cutting means to cut the copying paper into a length corresponding to the length of the original when a copy is to be obtained at said first copying ratio, and said second paper feed initiating means commencing the feeding of the copy paper upon actuation thereof and said second cutter actuating means being actuated during the scanning movement of said carriages for actuating said cutting means to cut the copy paper into a length corresponding to a length $n$ times the length of the original.

8. An electrophotographic copying apparatus as claimed in claim 7 wherein said first and second paper feed initiating means and said first and second cutter actuating means are actuated by a means provided on said first carriage during the movement thereof.

9. A slit exposure type electrophotographic copying apparatus utilizing a roll type storage of copy paper and having means for selectively producing an image of an original at a first copying ratio of 1:1 and at a second copying ration of 1:$n$ wherein $n$ is a magnification power other than 1, the apparatus comprising:

a reciprocatingly movable original holder table having a transparent member for supporting the original to be copied and a reference member for aligning one end of the original therewith;

a slidable indicator member slidable along the original for alignment with the other end of the original;

an optical means disposed below said table and including at least first and second optical means for projecting an image of the original;

means for shifting said first and second optical means between first and second positions wherein said optical means are in said first positions at said first copying ratio and in said second positions at said second copying ratio;

means for scanning said table at a first speed corresponding to the first copying ratio and at a second speed corresponding to the second copying ratio which is $1/n$th the speed of the first speed;

paper cutting means;

means for feeding the copy paper along a predetermined path through said paper cutting means and said image producing means, said copy paper initially having a leading edge at said cutting means and being fed therefrom;

a first scan initiating means for initiating a scanning movement of said table at a first speed corresponding to said first copying ratio and a second scan initiating means for initiating scanning movement of said table at a second speed corresponding to said second copying ratio, said first and second scan initiating means being provided in the path of said copy paper for actuation by the leading edge thereof with said first scan initiating means being provided at a distance of $d$ from said cutting means where the leading edge of the copy paper is at and said scan initiating means provided at a distance of the sum of said $d$ and $\Delta d$, and first and second cutter actuating means for actuating said cutting means in accordance with the selected first and second copying ratios respectively, said first and second cutter actuating means being provided in spaced apart relation separated by the distance $(d+\alpha d-nd)/n$, both of said actuating means being provided in the scanning path of said table for actuation during the scanning movement of said table;

said first scan initiating means commencing the scanning movement of said table upon actuation thereof and said first cutter actuating means being actuated during the scanning movement of said table for actuating said cutting means to cut the copy paper into a length corresponding to the length of the original when a copy is to be obtained at said first copying ratio, and said second scan initiating means commencing the scanning movement of said table upon actuation thereof and said second cutter actuating means being actuated during the scanning movement of said table for actuating said cutting means to cut the copy paper into a length corresponding to $n$ times the length of the original when a copy is to be obtained at said second copying ratio.

10. An electrophotographic copying apparatus as claimed in claim 9 wherein said first and second cutter actuating means are actuated by means provided integrally with said slidable indicator member for actuation during the scanning movement of said table.

11. An electrophotographic copying machine comprising:

means for holding an original;

means for indexing the length of said original;

means for withdrawing copy paper from a roll type storage and feeding said paper along a predetermined path through an image receiving station;

means for scanning the original so as to produce an image corresponding to the original on said copy paper at said image receiving station;

means for adjusting the magnification of said image relative to said original and including means for adjusting the speed of said scanning means in accordance with the magnification;

means for transversely cutting said copy paper; and means for actuating said cutting means in accordance with said scanning means speed and said indexing means to cut said copy paper to approximately the length of the image produced thereon.

12. The electrophotographic machine of claim 11 wherein said indexing means includes an indexing member movable on said holding means along the length of said original, said scanning means includes an optical element movable along the length of said original during a copying cycle and said cutting actuating means includes a switch movable with said indexing member and a switch actuator movable with said optical element to actuate said switch proximate the termination of a scanning stroke, said cutting means being responsive to the actuation of said switch.

13. The electrophotographic machine of claim 11 wherein said holding means is longitudinally slidable, said indexing means includes an indexing member movable on said holding means along the length of said original, said scanning means includes means for longitudinally advancing said holding means during an original scanning cycle and said cutting actuating means includes a switch actuator movable with said indexing member and a switch located in the path of said actuator and actuated thereby proximate the termination of a scanning stroke, said cutting means being responsive to the actuation of said switch.

14. An electrophotographic copying apparatus having first and second image specification rations of 1:1 and 1:*n* respectively comprising:

an original holder table for supporting an original to be copied;

a rotatable photosensitive member onto which an image of the original is projected and an image transferring means for transferring the original image onto copy paper;

means for feeding copy paper along a predetermined feed path through said image transferring means;

scanning means for scanning the original at a first speed for the first copying ratio and at a second speed which is 1/*n*th the first speed for second copying ratio;

a first paper feed initiating means actuatable with the first copying ratio for energizing said feeding means to feed copy paper;

a second paper feed initiating means actuatable with the second copying ratio for energizing said feeding means to feed copy paper;

said first and second paper feed initiating means being respectively actuated whereby to effect the arrival of the leading edge of copy paper at said image transferring means substantially coincidentally with the arrival of the leading edge of original image formed on the photosensitive member at said image transferring means.

15. An electrophotographic copying apparatus as claimed in claim 14 wherein said first and second paper feed initiating means are located in the path of scanning means and actuatable thereby to energize said feeding means.

16. An electrophotographic copying apparatus having selective first and second image magnification copying ratios comprising:

an original holder table for supporting an original to be copied and means for forming an image of the original on copy paper;

means for feeding copy paper;

scanning means for scanning the original at a first speed and a second speed corresponding to said first and second copying ratios respectively;

a first scan initiating means for initiating the scanning movement of said scanning means at said first speed and a second scan initiating means for initiating the scanning movement of said scanning means at said second speed, said first and second scan initiating means being actuated respectively in accordance with the selected copying ratio so as to effect the formation of the image of the original on the copy paper with the leading edge of the original image coinciding with the leading edge of copy paper.

17. An electrophotographic copying apparatus as claimed in claim 16 wherein said first and second scan initiating means are provided in the feeding path of the copy paper and are actuatable by the copy paper.

18. A slit exposure type electrophotographic copying apparatus having means for selectively reproducing an image of an original at a first copying magnification ratio of 1:1 and at a second copying magnification ratio of 1:*n* wherein *n* is magnification power other than 1, comprising:

an original holder table having a transparent member for supporting an original to be copied and a reference member for aligning one end of the original therewith;

an optical scanning means disposed below said table and and including a first carriage with at least a first mirror, a second carriage with at least a second mirror, and a projection lens disposed in the optical path of said mirrors, said first and second carriages being movable across the table at a speed ratio of 1:½;

means for advancing said first carriage attendant to scanning at a first speed corresponding to said first copying ratio with the second carriage following the movement of said first carriage at a half the speed thereof and at a second speed corresponding to said second copying ratio with is 1/*n*th the speed of the first speed with said second carriage following the movement of said first carriage at a half the speed of the first carriage;

a photosensitive member at the terminal end of the optical path for the projection of the image of the original thereon and including about the surface thereof a charging means, an exposure slit means and image transferring means;

means for feeding said copy paper along a predetermined path through said image transferring means, said copy paper initially having a leading edge at a predetermined position spaced from said image transferring means and being fed therefrom;

a first paper feed initiating means for initiating feeding of the copy paper by said feeding means responsive to the selection of said first copying ratio and a second paper feed initiating means for initiating feeding of the copy paper by said feeding means responsive to the selection of said second copying ratio, said first and second paper feed initiating means being separately located in the scanning path of said carriage, said first paper feed initiating means being disposed at a distance difference from said one end of the original aligned with said reference edge member wherein said distance difference is the difference between the distance from said predetermined position where the leading edge of the copy paper is to said image transferring means where the leading edge of the copy paper coincides with a leading edge of the image formed on said photosensitive member and the surface distance of said photosensitive member from the leading edge of the image formed at said exposure slit to where the leading edge of the image coincides with the leading edge of the copy paper where said image transferring means is located, said second paper feed initiating means being provided at said distance difference divided by said magnification power *n* from said one end of the original aligned with said reference member;

said first and second paper feed initiating means commencing the feeding of the copy paper upon actuation thereof respectively to feed the copy paper to said image transferring means, the leading edge of copy paper arriving at said image transferring means in coincidence with the arrival of leading edge of image formed on the photosensitive member.

19. A slit exposure type electrophotographic copying apparatus having means for selectively producing an image of an original at a first copying ratio of 1:1 and at a second copying ratio of 1:*n* wherein *n* is a magnification power other than 1, the apparatus comprising:

a reciprocatingly movable original holder table having a transparent member for supporting the original to be copied and a reference member for aligning one end of the original therewith;

an optical means disposed below said table and including at least first and second optical means for projecting an image of the original;

means for scanning said table at a first speed corresponding to the first copying ratio and at a second speed corresponding to the second copying ratio which is 1/*n*th the speed of the first speed;

a photosensitive member at the terminal end of the optical path for the projection of the image of the original thereon and including about the peripheral surface thereof a charging means, an exposure slit means and image transferring means;

means for feeding said copy paper along a predetermined path through said image transferring means, said copy paper initially having a leading edge at a predetermined position apart from said image transferring means and being fed therefrom;

a first scan initiating means for initiating a scanning movement of said table at a first speed corresponding to said first copying ratio and a second scan initiating means for initiating scanning movement of said table at a second speed corresponding to said second copying ratio, said first and second scan initiating means being provided in the path of said copy paper for actuation by the leading edge thereof with said first scan initiating means being provided at a distance of *d* from said predetermined position where the leading edge of the copy paper is at, and said second scan initiating means provided at a distance of the sum of said *d* and $\Delta d$;

said first and second scan initiating means commencing the scanning movement of said table upon actuation thereof respectively, the leading edge of the image formed on the photosensitive member arriving at said image transferring means in coincidence with the arrival of the leading edge of the copy paper.

* * * * *

UNITED STATES PATENT AND TRADEMARK OFFICE

CERTIFICATE OF CORRECTION

PATENT NO. : 4,126,389

DATED : November 21, 1978

INVENTOR(S) : Hiroshi Ikeda and Kenichi Arai

It is certified that error appears in the above-identified patent and that said Letters Patent are hereby corrected as shown below:

[73] Minolta Camera Kabushiki Kaisha
Osaka, Japan

Signed and Sealed this

*Sixth* Day of *March 1979*

[SEAL]

*Attest:*

RUTH C. MASON
*Attesting Officer*

DONALD W. BANNER
*Commissioner of Patents and Trademarks*